United States Patent [19]

Lush

[11] 4,120,060

[45] Oct. 17, 1978

[54] MATTRESS CONSTRUCTION

[76] Inventor: Richard C. Lush, 1922 E. 14 St., Brooklyn, N.Y. 11229

[21] Appl. No.: 853,278

[22] Filed: Nov. 21, 1977

Related U.S. Application Data

[63] Continuation-in-part of Ser. No. 627,532, Dec. 31, 1975, abandoned.

[51] Int. Cl.[2] ..... A61G 7/02

[52] U.S. Cl. ..... 5/345 R; 5/91; 5/327 R; 5/355

[58] Field of Search ..... 5/91, 317 R, 319, 327 R, 5/327 B, 335, 338, 345, 347, 355

[56] References Cited

U.S. PATENT DOCUMENTS

| | | | |
|---|---|---|---|
| 2,537,652 | 1/1951 | Churchill | 5/354 |
| 3,135,974 | 6/1964 | Roman | 5/345 R |
| 3,258,791 | 7/1966 | Kaplan | 5/347 |
| 3,742,528 | 7/1973 | Munch | 5/345 R |
| 3,974,532 | 8/1976 | Ecchuya | 5/345 R |

*Primary Examiner*—Casmir A. Nunberg
*Attorney, Agent, or Firm*—Martin Smolowitz

[57] ABSTRACT

An improved mattress construction with a ticking having at least one transverse row of protuberances in the form of a plurality of ridges integral with the ticking across the width of the mattress. Each row is positioned away from the foot of the mattress for a sufficient distance along the length of the mattress to permit engagement of the toes of the user within the spaces between the protuberances.

8 Claims, 4 Drawing Figures

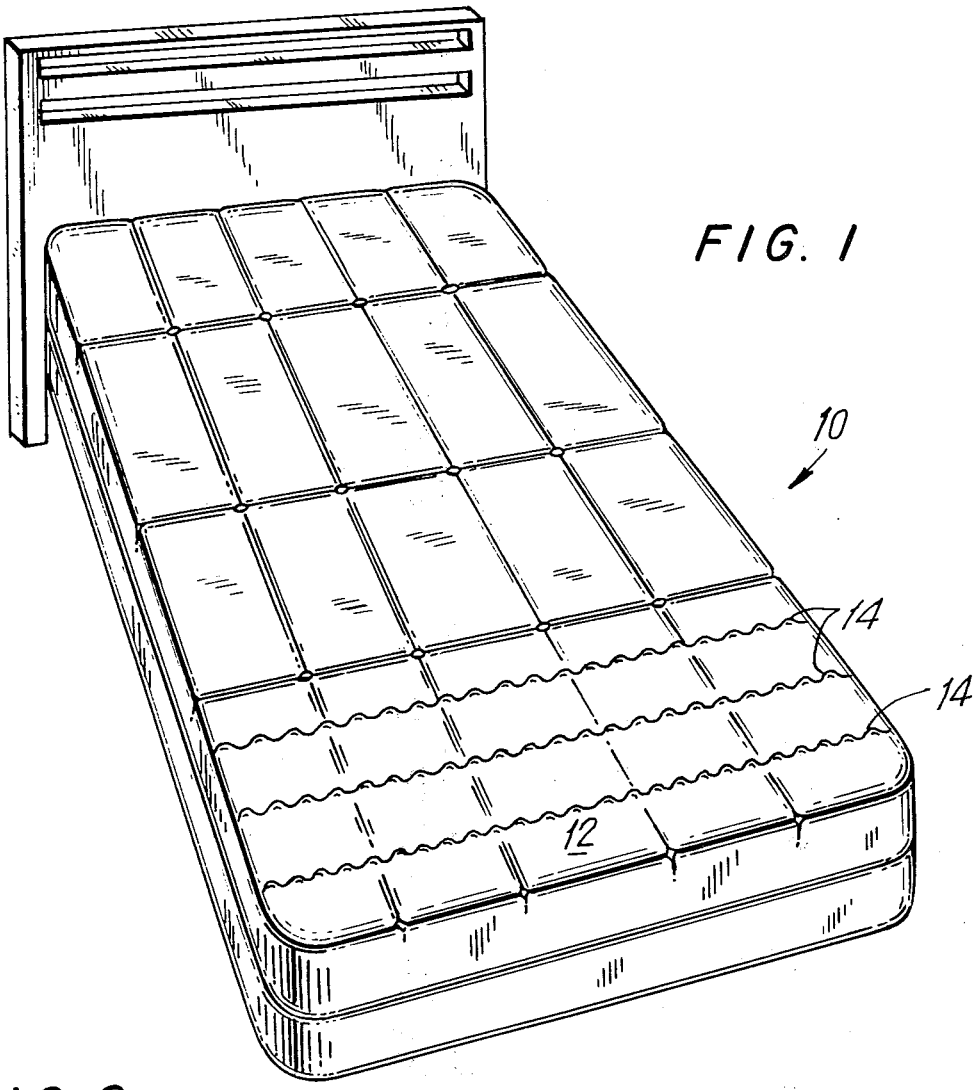
FIG. 1
FIG. 2
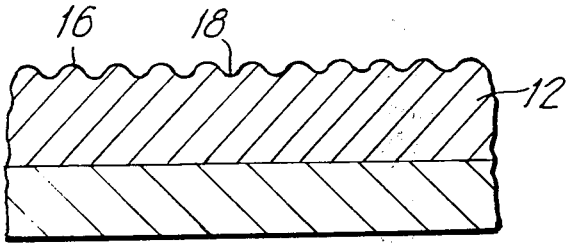
FIG. 3
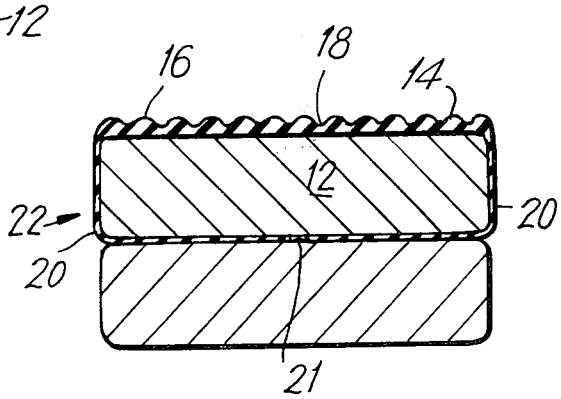
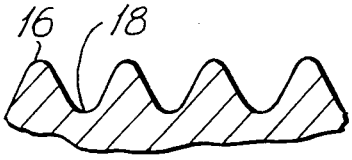
FIG. 4

MATTRESS CONSTRUCTION

BACKGROUND OF THE INVENTION

The present invention is a continuation-in-part application of my pending application entitled, Improved Mattress, U.S. Ser. No. 627,532 filed Dec. 31, 1975 now abandoned.

The invention relates to an improved mattress. More particularly, the invention relates to specially designed mattress that is adapted to make the sleeper more comfortable.

The prior art has endeavored to employ different mattress constructions and attachments with a view toward improving mattress comfort. For example, U.S. Pat. No. 1,548,728 calls for an upper portion having a breathing opening, while the lower portion is provided with sections that are slidable to vary the size of a foot receiving opening. U.S. Pat. No. 1,379,147 is directed to a mattress employing a transverse aperture for accommodation of the users feet when in the normal position is in the face down position. Another prior art mattress is shown in U.S. Pat. No. 2,244,435 which has an opening at one end to enable improved breathing while lying on the stomach. U.S. Pat. No. 2,570,736 is directed to a mattress having a plurality of breathing vents at one end and pockets or depressions in longitudinal alignment with the openings for placement of the toes while lying with the stomach downward. U.S. Pat. No. 2,767,410 discloses a mattress with a foothold at one end in the form of an angular depression. Still another prior art patent U.S. Pat. No. 3,135,974 is directed to a face rest mattress employing indentations for air circulation in the form of slots extending for a partial distance from the head to the foot of the mattress. The spacing of the slots in the mattress is particularly designed to be accommodative to the individual lying face down.

All of these arrangements and devices fail to provide a simple and inexpensive arrangement whereby the conventional mattress may be formed with a plurality of abutment surfaces for engagement with the toes to more positively position the user with respect to the mattress. The prior art in fact has failed to consider this condition in structuring mattresses as typified by the above-mentioned prior art patents. The ability for the user to engage his toes while still being able to move comfortably in the lateral direction without much stress and strain on the back and sides is an important consideration of the present invention.

Prior art attempts to handle special situations necessitating positioning of the feet or parts thereof, have all needed especially complex mattress configurations or adjustments.

SUMMARY OF THE INVENTION

It is accordingly the main object of the instant invention to provide for an improved mattress free from defects of the prior art.

It is another object of the invention to provide for an improved mattress assembly that may be formed as part of a conventional mattress.

It is a further object of the present invention to provide for the foregoing at relatively modest additional cost above that of a conventional mattress.

The principal feature of the present invention is directed to a mattress construction adapted to provide for positioning of a users toes while lying on the stomach, along designated locations on said mattress, for transmittal of body movement through said toes by co-action with said mattress, said mattress including: an outer ticking layer; at least one transverse row of protuberances integral with said ticking across the entire width of said mattress; said row being disposed away from a foot end of said mattress for a sufficient distance along the length of the mattress to co-act with the toes of said user at the surfaces between the protuberances.

Still another feature of the present invention is directed to a unitary member positionable upon the ticking surface of a mattress, said member being adapted to allow for positioning of a users toes on said member along designated locations while lying on the stomach, for transmittal of body movement through said toes by co-action with said member, said member including: a base section with a main portion having a flat surface positionable on said mattress across its width; an opposing surface of said base section defining a plurality of protuberances; flexible side members formed of said base section adapted to engage said mattress at its sides and undersurface; and locking means for locking said side members to thereby fixedly position said unitary member on said mattress.

These and other objects of the present invention will become more apparent from the following specification; claims and drawings in which:

IN THE DRAWINGS

FIG. 1 is a top plan view of a mattress including the instant invention;

FIG. 2 is a fragmented detailed front elevational view thereof;

FIG. 3 is a cross-sectional view employing an alternate embodiment of the present invention; and FIG. 4 illustrates an alternate formation of protuberances as employed in FIGS. 2 and 3.

PREFERRED EMBODIMENT

Referring to the drawings, in FIG. 1 there is shown a conventional type mattress 10 that may be made in any suitable length and width. The mattress 10 is comprised of an outer layer of ticking 12 that is filled in the conventional manner with foam rubber, isocyanate foam, or the like. The present invention contemplates modifying the ticking 12 and hence the surface of the mattress 10 itself. When lying in the stomach down position, it is at times, desirable to have the feet and more particularly the toes positively engaged with respect to the mattress, to enable movement of the lower portion of the back without undue stress. In this type of situation, the toes when firmly engaged with respect to the mattress permits the body to respond to force generated through the feet by way of the toes rather than by lower back. It follows, that the present invention contemplates an improvement in mattress construction particularly suitable for conditions where the user may seek to employ the invention as a means for assisting the feet to impart forces to other parts of the body without exerting undue effort on the lower back. The ticking layer 12 according to the invention defines at least one, preferably three rows of convoluted ridges 14, defining a plurality of peaks 16 and valleys 18 that are generally uniformally spaced apart as shown in FIG. 2. The protuberances formed are generally hemispherical in shape. The row of ridges 14 is disposed transverse to the longitudinal axis of the mattress 10 and preferably extends from one side of the mattress to the other. The foregoing arrangement is disposed upon both surfaces of the mattress 10 such that the same may be used in the flipped position. The row of ridges 14 is intended to accommodate the toes of the user in a comfortable manner across the width of the bed. When the mattress 10 is being fabricated, the rows 14 can be constructed in the customary manner such as by tufting or the like. Where three rows 16 are employed, the first or lower row 14 is disposed about ¼ from the foot of the mattress 10 and each successive row being 6 inches from its neighbor. The protuberances formed as shown in FIG. 2 may for example, be 1½ inches high from the base of the valley 18 to the peak 16.

The aforementioned spatial requirements are intended to cover the greatest number of potential persons being of average size. Obviously, variations in the distances between rows of ridges 14 as they are spaced along the mattress 10 can be made without departing from the spirit of the invention, providing of course, the users toes are able to engage the inventive mattress as set forth hereinbefore.

FIG. 4 illustrates an alternate embodiment for the formation of indentations 14 which form the protuberances in the ticking 12. These are somewhat frusto conical in shape and are smooth at the peak 18 to avoid any discomfort for the user.

ALTERNATE EMBODIMENT

An alternate embodiment of the present invention in the form of a unitary member 22 is shown in FIG. 3. In this arrangement the ridges 14 are preformed on a base member 19 having bands 20 which extend to the underside of the mattress and are joined by snapping engagement at 21. The respective rows are positionable at will by the user at distances along the lower portion of the mattress 10 to suit his immediate needs. Obviously, one or more rows can be affixed to the mattress 10 at will. Furthermore, in this instance, the mattress may be any commercially available mattress which is thusly modified. The aforementioned arrangement offers portability and can be taken by the user from his home to elsewhere should the need arise. The bands 20 may be of elastic material which is stretched around the mattress and snapped in place by a snap or other suitable locking arrangement.

As shown in FIG. 3, this embodiment has a member 19 having a substantially flat surface that is adapted to contact the mattress 10 while the opposing surface defines the peaks 16 and valleys 18. The member 22 is adapted to be somewhat flexible so that it will fit over and across the mattress to be positioned thereon, with bands 20 contacting the side of the mattress 10. The member 22 is preferably constructed of a shape retaining material such as, foam rubber, that is comfortable to lie upon yet achieves the intended purpose. It is intended that the alternate embodiment serve in the same manner as set forth hereinbefore. The weight of the user, the mattress 10 and the force fit by employment of the band 20, all contribute toward maintaining the unitary member in its place on the mattress 10. The ridges 14 are intended to have the same characteristics such as, size and shape as for the preferred embodiment.

A variant of the above includes having the bands 20 formed as a single band, much like a rubber band that can be stretched around the mattress without the need for a locking arrangement for joining the loose ends.

Since it is obvious that numerous changes and modifications can be made in the above-described details without departing from the spirit and nature of the invention, it is to be understood that all such changes and modifications are included within the scope of the invention.

I claim:

1. An improved mattress construction having means for acting with a users feet at the foot end of said mattress and allowing positioning of a users toes while lying on the stomach, said means being disposed along designated locations across said mattress for transmittal of body movement through said users toes with said means, said mattress being provided with a generally planar outer ticking layer wherein said improvement comprises: said mattress being provided with means having at least one transverse row of uniformly spaced protuberances integral with said ticking across the entire width of said mattress to define means adapted to co-act with said toes, said means being disposed away from said foot end of said mattress for a distance along the length of said mattress to enable engagement of the toes of said user at surfaces formed by the protuberances.

2. An improved mattress as defined in claim 1 wherein: said one transverse row is one-quarter from the foot end of said mattress.

3. A mattress as defined in claim 1, further including: additional transverse rows disposed 6 inches from each neighboring row and having protuberances hemispherical in shape.

4. An improved mattress as defined in claim 1, further including: additional transverse rows disposed 6 inches from neighboring rows and having protuberances frusto conical in shape.

5. An improved mattress as defined in claim 1 wherein: said protuberances are substantially uniformally spaced apart and being one and one-half inches in height.

6. An improved mattress as defined in claim 1 wherein: said rows of protuberances are three in number.

7. A unitary member positionable upon the ticking surface of a mattress said member being adapted to allow for positioning of a users toes on said member along designated locations while lying on the stomach, for transmittal of body movement through said toes by co-action with said member, said member including: a base section; said base section having a main position with a flat surface positionable on said mattress across its width in the form of a continuous elastic band adapted to be stretch-fitted upon said mattress; a surface opposite said base section defining a plurality of protuberances being hemispherical in shape and substantially uniformally spaced apart along said opposing surface; flexible side members formed of said base section adapted to engage at its sides and undersurface; and means for fixedly positioning said unitary member on said mattress.

8. A unitary member as claimed in claim 7, wherein: said protuberances being frusto conical in shape and substantially uniformally spaced apart along said opposing surface.

* * * * *